United States Patent [19]

Franz et al.

[11] 4,332,182

[45] Jun. 1, 1982

[54] APPARATUS FOR TRANSPOSING PASSAGES IN ELECTRONIC MUSICAL INSTRUMENTS

[75] Inventors: Reinhard Franz, Tulpenstrasse 15, D-5401 Emmelshausen, Fed. Rep. of Germany; Wilfried Dittmar, Halsenbach, Fed. Rep. of Germany

[73] Assignee: Reinhard Franz, Emmelshausen, Fed. Rep. of Germany

[21] Appl. No.: 222,895

[22] Filed: Jan. 6, 1981

[30] Foreign Application Priority Data

Jan. 10, 1980 [DE] Fed. Rep. of Germany ..... 3000704

[51] Int. Cl.[3] ..... G10H 1/20; G10H 5/06

[52] U.S. Cl. ..... 84/1.01; 84/445; 84/477 R

[58] Field of Search ..... 84/1.01, 445, 447 R, 84/DIG. 11

[56] References Cited

U.S. PATENT DOCUMENTS

| | | | |
|---|---|---|---|
| 3,023,659 | 3/1962 | Bode | 84/445 |
| 3,610,800 | 10/1971 | Deutsch | 84/1.01 |
| 3,674,907 | 7/1972 | Derry | 84/1.01 |
| 3,824,325 | 7/1974 | Obayashi et al. | 84/1.01 |
| 3,877,337 | 4/1975 | Obayashi et al. | 84/1.01 |
| 3,910,149 | 10/1975 | Obayashi | 84/1.01 |
| 3,933,072 | 1/1976 | Van Der Wal et al. | 84/1.01 |
| 4,058,042 | 11/1977 | Wade et al. | 84/1.01 |
| 4,176,573 | 12/1979 | Deutsch | 84/1.01 |

FOREIGN PATENT DOCUMENTS

| | | | |
|---|---|---|---|
| 53-66210 | 6/1978 | Japan | 84/445 |

*Primary Examiner*—Stanley J. Witkowski
*Attorney, Agent, or Firm*—Kontler & Grimes

[57] ABSTRACT

An electronic organ, piano or accordion has a transposing apparatus wherein a voltage-regulated high-frequency oscillator transmits high frequency signals to the input of a 12-tone divider circuit whose outputs transmit tone frequency signals to the tone generator of the musical instrument. The oscillator receives regulating signals from a switching unit, such as a multiplexer or a battery of integrated circuits, and the intensity of such signals is a function of addressing signals which are transmitted to the switching unit by an addressing unit having a keyboard with keys which are actuatable by the player to initiate the generation of different addressing signals as a result of closing of electric switches which are associated with the keys. The distribution of keys in the keyboard is the same as the distribution of playing keys in the keyboard of a piano, organ or a like musical instrument. If the keys are the playing keys of the musical instrument, the addressing unit is provided with an auxiliary switch which can be closed in response to actuation of a digital or a pedal to move from a first (open) position in which the keys are unable to effect the generation of addressing signals and act solely as playing keys to a second (closed) position in which the keys can effect the generation of addressing signals. The addressing unit is further provided with a storage whose output transmits to the switching unit a selected addressing signal until the player decides to actuate another key to thereby select a different addressing signal.

28 Claims, 3 Drawing Figures

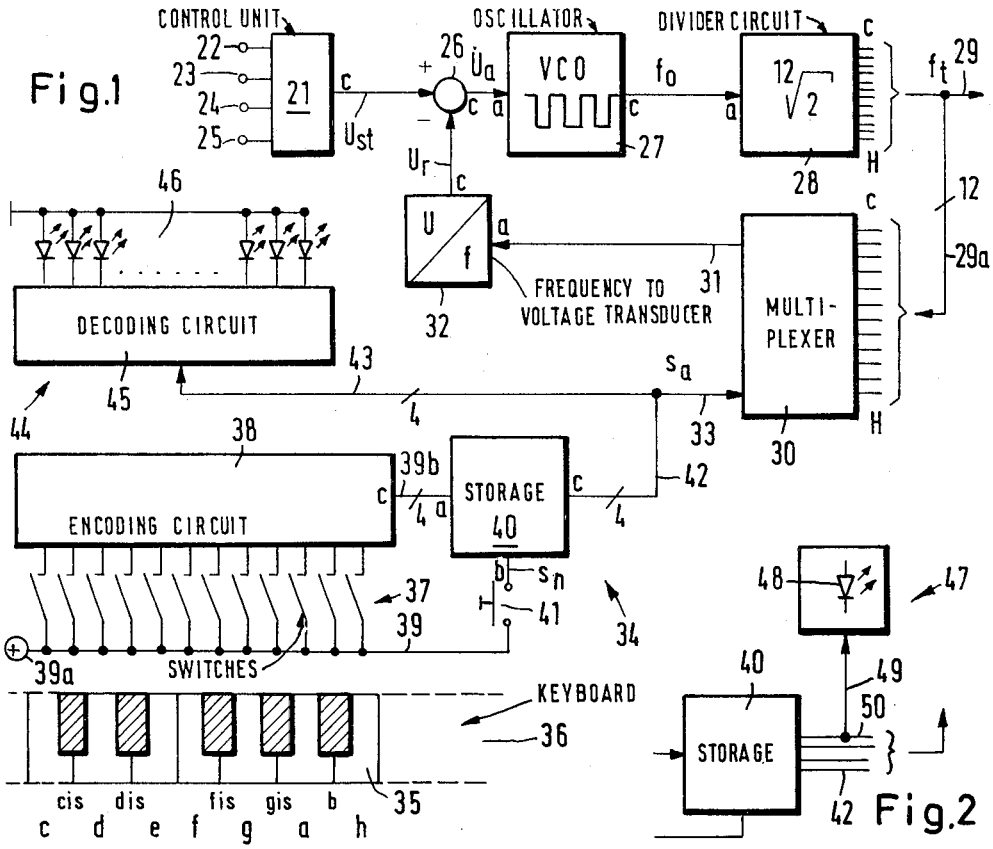
Fig.1
Fig.2
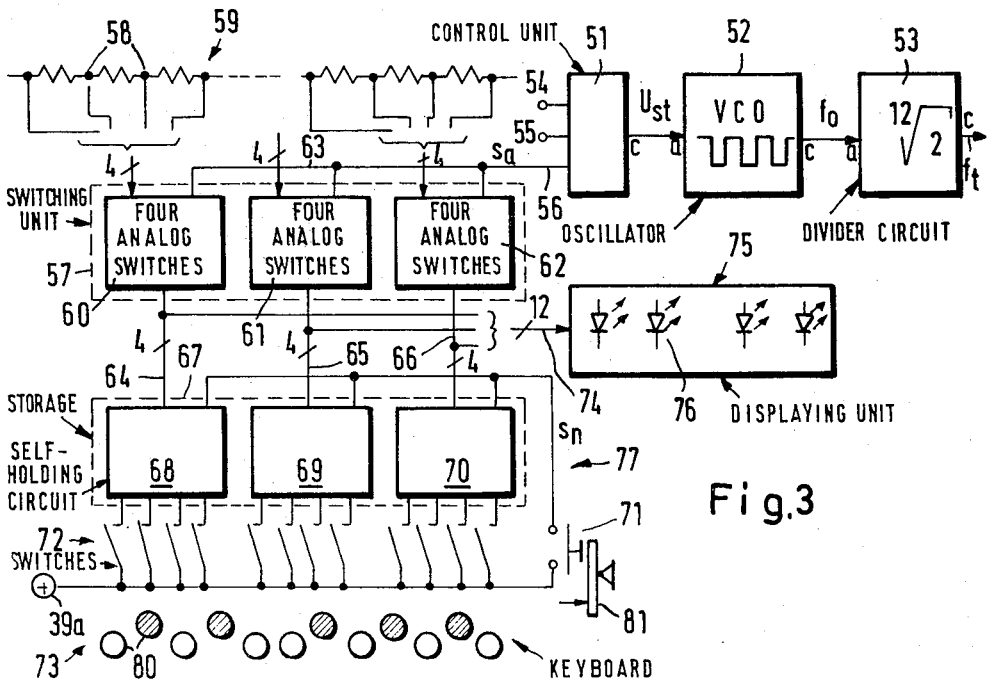
Fig.3

APPARATUS FOR TRANSPOSING PASSAGES IN ELECTRONIC MUSICAL INSTRUMENTS

BACKGROUND OF THE INVENTION

The present invention relates to transposing apparatus in general, and more particularly to improvements in apparatus for transposing musical compositions or passages in electronic organs, electronic pianos and analogous electronic musical instruments. Still more particularly, the invention relates to improvements in transposing apparatus for the tone generators of electronic musical instruments, especially to improvements in transposing apparatus of the type wherein the main or primary generator is a voltage-regulated high frequency oscillator whose output means is connected with a 12-tone divider circuit having outputs which can furnish the tone frequencies of an octave, and wherein the control voltage for the primary generator is regulated by a switching arrangement having discrete inputs and a common output.

A presently known transposing or transposition apparatus of the above outlined character comprises a switching arrangement having a multi-position switch which can be rotated or shifted to assume any one of twelve different positions each representing a different type of tone. For example, the inputs of this conventional multi-position switch can be connected to the taps of a voltage divider having a single output connected, either directly or through the medium of additional switching means, with the voltage-regulated high frequency oscillator which constitutes the main or primary generator of the transposing apparatus. In accordance with another prior proposal, the inputs of the switching arrangement are connected with the outputs of a 12-tone divider, and the output of the switching arrangement is connected with a phase comparing circuit which controls the main or primary generator. The phase comparing circuit further receives a reference frequency signal.

In each of the aforedescribed conventional transposing apparatus, the movable portion of the multi-position switch must cover different distances (e.g., by rotating about a fixed axis or by performing a translatory movement) in order to place the switch in a desired condition. The distance which the movable part or parts of the switch must cover depends on the nature of the selected transposition, i.e., on the desired change of the musical composition or passage. Such shifting of the movable part of the switch to a different position consumes time and requires at least some attention from the player of the electronic musical instrument. Therefore, the transposing apparatus is normally actuated when the musical instrument is not in actual use. Furthermore, the difficulty of selecting the desired different transposition increases with the speed of making the corresponding adjustment of movable portion of the multi-position switch.

OBJECTS AND SUMMARY OF THE INVENTION

An object of the invention is to provide a novel and improved transposing or transposition apparatus whose manipulation requires little attention from a player, especially from a skilled player, and which renders it possible to select a different key (transposition) with little loss in time.

Another object of the invention is to provide a novel and improved switching arrangement for the transposing apparatus of an electronic organ, electronic piano, electronic accordion or an analogous electronic musical instrument.

A further object of the invention is to provide a transposing apparatus which can be installed in a wide variety of presently known electronic musical instruments as a superior and simpler substitute for heretofore known transposing or transposition apparatus.

An additional object of the invention is to provide a transposing apparatus whose manipulation can be understood after a minimum of training or practicing, or without any training, and whose manipulation is more convenient and more readily comprehensible than that of conventional transposing apparatus.

The invention is embodied in an electronic musical instrument, and more particularly in a transposing apparatus which can transmit tone frequency signals to the tone generator of a musical instrument, especially an electronic piano, organ or accordion. The transposing apparatus comprises a voltage-regulated main or primary generator (preferably high-frequency oscillator) having input means for regulating signals and output means for transmission of high-frequency signals, a divider circuit (preferably a 12-tone divider) having input means connected with the output means of the main generator and output means arranged to transmit tone frequency signals (the output means of the divider circuit may be directly or indirectly connected with the tone generator of the musical instrument and is designed to transmit tone frequency signals of an octave), a multiplexer, a series of interconnected integrated circuits or another suitable electronic switching unit having output means (preferably a single output) for transmission of regulating signals to the input means of the main or primary generator and a plurality of inputs, and an addressing unit for transmitting addressing signals to the inputs of the switching unit so that the latter can transmit appropriate regulating signals to the input means of the main generator. The addressing unit includes a keyboard having a plurality of keys which are actuatable by the player of the electronic musical instrument to effect the generation of addressing signals (preferably addressing signals in the form of binary signals), one for each input of the switching unit.

The addressing unit preferably further comprises a storage for continuous transmission of a selected addressing signal to the switching unit, i.e., the addressing signal is transmitted until the player decides to actuate another key to thus generate or initiate the generation of a different addressing signal.

In accordance with an advantageous further development of the invention, the mutual positions (i.e., the distribution) of keys in the keyboard of the addressing unit correspond to mutual positions of playing keys on the keyboards of musical instruments. This enables a player to rapidly select the desired transposition. The selection is even simpler if the keys of the keyboard are the playing keys of the musical instrument, i.e., if the keys are the digitals of an upper keyboard or the pedals of a lower keyboard in an electronic piano or the like. The addressing unit then further comprises a selector (e.g., an auxiliary switch which can be actuated by the player through the medium of a further pedal or digital) movable between a first position in which the keys of the keyboard are actuatable to perform the functions of playing keys and a second position in which the keys are actuatable to effect the generation of corresponding addressing signals.

As a rule, the addressing unit will comprise a discrete switch for each key. Such discrete switches are operable to generate or to initiate the generation of corresponding addressing signals in response to actuation of the associated keys. The keys may be digitals (in the form of levers or buttons) or pedals.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a diagram showing the components of a first transposing apparatus which embodies the present invention;

FIG. 2 illustrates a portion of a transposing apparatus with a simplified display unit; and FIG. 3 is a diagrammatic view of a third transposing apparatus with digitals in the form of depressible buttons.

DESCRIPTION OF THE PREFERRED EMBODIMENTS

Referring first to FIG. 1, there is shown a control unit 21 having an output c which transmits a control voltage signal $U_{st}$. By activating one of the four inputs 22, 23, 24 and 25 of the control unit 21, the voltage signal $U_{st}$ can be varied as a function of time, for example, to achieve different effects such as hawaiian, slalom, vibrato, etc. A signal comparing stage 26 is connected with the output c of the control unit 21 to compare the control voltage signal $U_{st}$ with a reference signal $U_r$, namely, a feedback signal which is applied by the output c of a frequency-voltage converter circuit 32. The signal $U_a$ at the output c of the signal comparing stage 26 is transmitted to the input a of a voltage-regulated oscillator VCO which constitutes the main or primary generator 27 of the improved transposing apparatus. The output c of the primary generator 27 transmits a high-frequency signal $f_o$, e.g., in the range of 2 MHz. The signal $f_o$ is transmitted to the input a of a 12-tone divider circuit 28 having outputs C to H serving to transmit signals $f_t$ denoting frequencies of the twelve tones of an octave. These signals are conveyed by a conductor 29 having twelve channels and being connected, either directly or through the medium of additional divider means or voice circuits, with the electronic musical instrument, e.g., with the tone generator of an electronic piano, an electronic organ or an electronic accordion. The average frequency of signals $f_t$ is 6 kHz. The twelve tones of the octave are produced by dividing the high-frequency impulse series with a divisor which is a whole multiple of one; therefore, the internal dividing ratio of the divider circuit 28 i $\sqrt[(12)]{(2)}$ with reference to the highest tone of the octave. The tone frequency signals $f_t$ are further transmitted to the inputs C to H of a switching unit here shown as a multiplexer 30 by way of a branch conductor **29*a* with twelve channels. The output 31 of the multiplexer 30 is connected to the input a of the aforementioned frequency-voltage converter 32 whose output c transmits the reference signal $U_r$ to the corresponding input of the signal comparing stage 26 between the control unit 21 and the main or primary generator 27. The values of the high-frequency signal $f_o$ at the output c of the primary generator 27 vary as a function of the selected input (C to H) of the multiplexer 30, i.e., in dependency on that channel of the branch conductor 29*a* which transmits the tone frequency signal $f_t$ from one of the outputs C to H of the divider circuit 28 to the multiplexer 30. Thus, the nature of selected transposition will depend on the nature of the reference signal $U_r$ which is transmitted to the signal comparing stage 26**.

The multiplexer 30 has a further input or control input 33 which can receive binary addressing signals $s_a$ from an addressing unit 34. In accordance with a feature of the invention, the addressing unit 34 comprises switches 37 which are actuatable by the keys (digitals or pedals) 35 of a keyboard 36, i.e., the keyboard may be an upper or a lower keyboard. Each of the switches 37 can connect a source **39*a* of potential (note the conductor 39) with a selected input of an encoding circuit 38. The latter is a diode matrix whose output c is connected with the corresponding input a of a self-holding storage 40 by a four-channel conductor 39*b*. The input a of the storage 40 can accept binary signals via conductor 39*b* in response to application of a signal $s_n$ to its input b on closing of an auxiliary or selector switch 41. Consequently, the storage 40 stores that addressing signal $s_a$ whose generation has been initiated in response to depression of a selected key 35. In other words, the auxiliary or selector switch 41 must be closed simultaneously with closing of a selected key 35 on the keyboard 36. The thus stored signal is a binary signal and is transmitted to the control input 33 of the multiplexer 30 by way of a four-channel conductor 42. For example, when the player depresses the "c" key 35, the encoding circuit 38 generates a binary addressing signal $s_a$ which connects the input C of the multiplexer 30 with the output 31. The same holds true for the remaining keys 35 of the keyboard 36, i.e., depression of each of these keys results in connection of the output 31 with a different one of the inputs C to H of the multiplexer 30**.

The conductor 42 is further connected with a four-channel conductor 43 which transmits signals $s_a$ to a decoding circuit 45 forming part of a displaying unit 44. The decoding circuit 45 comprises an indicating element, here shown as light-emitting diode 46, for each of the various tone types. It is clear that the decoding circuit 45 can comprise other means for displaying the signals which are transmitted to the output 31 of the multiplexer 30. By observing or otherwise paying attention to the decoding circuit 45, the player can ascertain and thus confirm the correctness of the selected transposition, i.e., the accuracy of the selected connection between the output 31 and one of the inputs C to H of the multiplexer 30.

FIG. 2 illustrates a portion of a modified transposing apparatus wherein the displaying unit 44 of FIG. 1 is replaced with a displaying unit 47 having a single indicating element in the form of a light emitting diode 48. The displaying unit 47 is connected, by conductor means 49, with a single channel 50 of the four-channel conductor 42 which connects the output of the storage 40 with the multiplexer 30 (not shown in FIG. 2). The displaying unit 47 can be designed to generate a visible signal (1 or 0) in response to development of a single address. The arrangement of FIG. 2 can serve to denote the basic tuning of the electronic musical instrument (e.g., an electronic organ). As a rule, the basic tuning is in c-dur.

Referring now to FIG. 3, there is shown a further transposing apparatus wherein a control unit 51 has an output c for transmission of a voltage signal $U_{st}$ to the input a of a main or primary generator 52 here shown as a voltage-regulated high-frequency oscillator VCO. The high-frequency signal $f_o$ which is transmitted by the output c of the primary generator 52 is applied to the input a of a 12-tone divider circuit 53, the same as in the embodiment of FIG. 1. The output c of the divider circuit 53 transmits tone frequency signals $f_t$ which are supplied to the musical instrument, such as an electronic organ or an electronic piano.

The inputs 54 and 55 of the control unit 51 can receive signals for the generation of special effects. The input 56 of the control unit 51 receives voltage signals $s_a$ from a switching unit 57 which comprises a potentiometer 59 having a plurality of taps 58 each connectable with the input 56 to transmit a different voltage signal $s_a$. The switching unit 57 further comprises three integrated circuits 60, 61 and 62 each of which comprises four analog switches. Any one of plural inputs of these analog switches can be connected with the output 63 of the switching unit 57 when the addressing unit 77 transmits a voltage signal by way of the corresponding one of three four-channel conductors 64, 65 and 66. Such signals are applied (one at a time) to the control electrodes of the selected analog switches in 60, 61, 62. The total number of analog switches is twelve. The effective addressing signal is stored in a storage 67 which consists of three 4-bit self-holding circuits 68, 69 and 70. The inputs of the self-holding circuits 68–70 of the storage 68 are enabled to receive signals in response to closing of an auxiliary switch or selector switch 71 in a conductor 77 which connects the source 39*a* of voltage with such inputs as soon as it is closed. The switches 72 which must be closed to effect the admission of signals into the respective self-holding circuits 68–70 of the storage 67 can be actuated by the keys 80 (here shown as depressible buttons) of a keyboard 73, e.g., a keyboard of the type used in certain accordions.

The 4-channel addressing conductors 64, 65 and 66 (each of which has four channels and connects the respective circuit 68, 69, 70 with the associated integrated circuit 60, 61, 62) are further connected with a twelve-channel conductor 74 for transmission of signals to a displaying unit 75 including twelve indicating elements 76 in the form of light emitting diodes. Each of these diodes denotes a different transposition.

The improved transposing apparatus is susceptible of many further modifications without departing from the spirit of the invention. For example, the pivotable keys 35 of the keyboard 36 or the depressible keys 80 of the keyboard 73 can be replaced by other types of digitals or pedals. The switches 37 or the switches 72 may constitute proximity switches or manually depressible switches. Moreover, all of the keys 35 and 80 can be disposed in a single row, and the keys (sharps) which are normally denoted by black color in a conventional keyboard can be designated by one or more colors other than black. As mentioned above, even though a keyboard of the type used in pianos is preferred in many instances because it is familiar to the players of organs, pianos and analogous instruments, the keyboard may comprise depressible buttons of the type shown in FIG. 3 and employed in certain types of accordions.

All or practically all of the illustrated units and/or circuits may constitute commercially available components, i.e., commercially available integrated circuits. For example, the following commercially available components can be used to constitute certain important or desirable elements of the improved transposing apparatus; the twelve-tone divider circuit 28 or 53 may be a model MO82 integrated circuit produced and sold by SGS ATES; the multiplexer 30 may constitute an integrated circuit produced by Motorola, National Semiconductor or RCA and offered for sale under order number 4067; the decoding circuit 45 may constitute an integrated circuit which is sold by RCA, National Semiconductor or Motorola and is offered under order number 4514; the storage 40 or the holding circuits 68, 69, 70 of the storage 67 may constitute integrated circuits sold by RCA, Motorola or National Semiconductor under order number 4042; and the analog switches 60, 61 and 62 may constitute integrated circuits sold by RCA, Motorola or National Semiconductor under order number 4016.

An important advantage of the improved transposing apparatus is that it utilizes an electronic switching arrangement having several inputs each of which can receive an addressing signal, that the apparatus utilizes an addressing unit with keys for generation of addressing signals, and in the provision of storage means for continuous transmission of the selected addressing signal. This renders it possible to transmit an addressing signal for any desired interval of time in response to short-lasting depression, pivoting or other mode of actuation of a selected key on the keyboard 36 or 73. In other words, the transposition into a different key can be effected with negligible loss in time so that such operation can be readily carried out while the respective electronic musical instrument is in actual use. Each key 35 or 80, i.e., each switch 37 or 72, is associated with a discrete input of the circuit which transmits or effects the transmission of signals $f_t$ to the electronic musical instrument proper. The storage means ensures that the player need not waste much time for selection of a given transposition and for retention of the selected transposition, i.e., the selected transposition will remain effective even if the player immediately releases the corresponding key 35 or 80. As stated above, the improved transposing apparatus renders it possible to change into another key (i.e., to select a different transposition) while the instrument is in actual use, and such operation does not compel the player to detract his or her attention from other operations which must be performed during playing.

The selection of a keyboard (36 or 73) which is familiar to many or most players of electronic or mechanical musical instruments is desirable and advantageous because it further reduces the likelihood that the selection of a given key 35 or 80 would necessitate much delibration and would waste much of the player's time. Thus, the distribution of keys 35 or 80 in the respective keyboard may be identical with the distribution of keys in the octaves of the keyboard of a known musical instrument (such as an organ, a piano or an accordion) so that the player can become accustomed to manipulation of the keyboard 36, 73 or an analogous keyboard without any or with negligible amount of training or practicing. In fact, the player can readily acquire sufficient expertise to select any desired transposition without even looking at the keyboard 36 or 73. This holds true regardless of whether the keys are pivotable digitals (such as the keys 35 of the keyboard 36), depressible pushbuttons (such as the keys 80 of the keyboard 73), proximity switches, manually actuatable (mechanically operated) switches or the like. In other words, all that counts is to ensure that the player can readily and rapidly select a desired key on the keyboard to thereby select the desired transposition which remains unchanged until or unless the player selects a different transposition by intentionally depressing another key 73 or 80.

A further advantage of the illustrated embodiments is that the keys 35 or 80 can be used to perform their primary or normal functions (i.e., the same functions as the playing keys of a conventional electronic musical instrument of the type including pianos, organs, accordions or the like). Otherwise stated, the playing keys can be used for selection of the desired tranposition. All that is necessary is to close the auxiliary switch 41 and 71 whereupon the playing keys of one or more octaves on the keyboard of the electronic musical instrument can be used for selection of a desired transposition. Such embodiments are especially desirable and advantageous because there is no need to provide a separate or discrete keyboard, i.e., the customary keyboard can also serve as a means for initiating the generation of electric signals which effect the selection of any one of a series of transpositions. This entails savings in space and contributes to lower cost of the musical instrument. For example, the main or primary function of the keys 35 or 80 may be to regulate the accompanying automaton and/or other components of an electronic organ or the like.

Even though the illustrated keyboards 36 and 73 employ manually depressible keys (digitals or pushbuttons), it is equally within the purview of the invention to select a keyboard which includes pedals, as long as the pedals or digitals are distributed in a manner which is familiar to the player. This even further reduces the intervals which are needed to select a different transposition since the hands and/or feet of the player normally rest on the corresponding keyboard or keyboards.

The design of the auxiliary or selector switch 41 or 71 can depart from the illustrated design. As a rule, or in accordance with the presently preferred embodiments of the invention, the auxiliary switch 41 or 71 is also actuatable by an additional or auxiliary key (such as a digital or a pedal) to further simplify the operation of the musical instrument. FIG. 3 illustrates, by way of example, a two-armed digital or pedal 81 which can be pivoted by a hand or by a foot to close the auxiliary switch 71. The position of the additional key 81 with reference to the buttons 80 of the keyboard 73 is such that the player can readily reach the key 81 while depressing a selected button 80. Thus, all that is needed to select a different transposition is to close, for a very short interval of time, the auxiliary switch 41 or 71 simultaneously with depression or other manipulation of the selected key 35 or 80.

It is also possible to modify the design of the storage or storages in the improved addressing apparatus. Thus, instead of storing an addressing signal which has been selected by a given key 35 or 80, the storage can be designed to receive a signal denoting the ordinal number of the selected key 35 or 80 and to generate a corresponding signal which is transmitted to the addressing unit so that the latter can apply an appropriate addressing signal to the multiplexer 30 or to the input 56 of the control unit 51.

When the keyboard 36 or 73 is the only keyboard of the respective electronic musical instrument, i.e., if the keys 35 or 80 are playing keys which perform main functions (such as actuating the accompanying means of the electronic musical instrument) plus secondary functions of selecting any one of several transpositions, that input of the storage 42 which receives addressing signals is preferably designed to be freed for reception of such addressing signals in response to transmission of a signal via auxiliary switch 41. This results in greatly simplified regulation of operation of the storage. As explained hereinbefore, the entire storage may be of extremely simple and compact design; for example, the storage may comprise one (FIG. 1) or more (FIG. 3) self-holding circuits.

If the addressing signals are binary signals, the encoding circuit 38 can be installed ahead of the storage (as shown in FIG. 1) or between the storage and the switching unit. The decoding circuit 45 is needed only if the addressing signals are in such form (e.g., in the form of binary signals) that they cannot be readily displayed to the player.

The simplified design of the displaying unit 47 which is shown in FIG. 2 is often sufficient when the player merely wishes to ascertain whether or not a transposition has been selected. Thus, if the diode 48 of FIG. 2 does not emit light, the player knows that the transposing apparatus has selected a desired transposition. On the other hand, if the light is on, the player knows that the storage 40 does not transmit a transposition signal, i.e., that the key corresponds to the basic tuning of the electronic musical instrument.

In the embodiment of FIG. 3, the intensity of addressing signals corresponds to the voltages taken off the corresponding taps 58. As shown in FIG. 3, the outputs of all three integrated circuits 60, 61, 62 of the switching unit 57 are connected to each other and to the input 56 of the control unit 51.

The number of inputs (C–H) at the right-hand side of the multiplexer 30 shown in FIG. 1 corresponds to the number of different addressing signals. This multiplexer is designed to accept addressing signals in the form of binary signals, i.e., the storage 40 receives signals from the encoding circuit 38.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In an electronic musical instrument, a transposing apparatus comprising a voltage-regulated main generator having input means for regulating signals and output means for transmission of high-frequency signals; a divider circuit having input means connected with said output means and output means arranged to transmit tone frequency signals; an electronic switching unit having output means for transmission of regulating signals to the input means of said main generator, said switching unit having a plurality of inputs; and an addressing unit for transmitting addressing signals to the inputs of said switching unit, said addressing unit including a keyboard having a plurality of keys actuatable by the player of the instrument to effect the generation of addressing signals, one for each input of said switching unit.

2. The transposing apparatus of claim 1, wherein said main generator includes a high-frequency oscillator and said divider circuit is a 12-tone divider circuit whose output means is connected with the tone generator of the electronic musical instrument and is arranged to transmit tone frequency signals of an octave, the output means of said switching unit including a single output.

3. The transposing apparatus of claim 1, wherein said addressing unit further comprises a storage for continuous transmission of a selected addressing signal to said switching unit.

4. The transposing apparatus of claim 1, wherein the mutual positions of said keys correspond to the mutual positions of playing keys on the keyboards of musical instruments.

5. The transposing apparatus of claim 1, wherein said keys are the playing keys of the musical instrument and further comprising selector means movable between first position in which said keys are actuatable to perform the functions of playing keys and a second position in which said keys are actuatable to effect the generation of said addressing signals.

6. The transposing apparatus of claim 5, wherein said selector means includes a player-operated auxiliary switch.

7. The transposing apparatus of claim 5, wherein said selector means forms part of said addressing unit.

8. The transposing apparatus of claim 1, wherein said addressing unit further comprises a discrete switch for each of said keys, said discrete switches being operable in response to actuation of the associated keys to initiate the generation of corresponding addressing signals.

9. The transposing apparatus of claim 8, wherein said keys are digitals.

10. The transposing apparatus of claim 8, wherein said keys are pedals.

11. The transposing apparatus of claim 8, further comprising selector means movable by the player of the musical instrument between a first position in which said keys can perform the functions of playing keys and a second position in which the actuation of said keys entails the generation of corresponding addressing signals.

12. The transposing apparatus of claim 11, wherein said selector means forms part of said addressing unit and includes an auxiliary switch which is open in said first position and closed in said second position of said selector means.

13. The transposing apparatus of claim 1, wherein said addressing unit further comprises a storage for continuous transmission of a selected addressing signal to said switching unit and a discrete switch for each of said keys, said switches being operable in response to actuation of associated keys to transmit corresponding addressing signals to said storage and said storage being arranged to transmit a thus received addressing signal to said switching unit until it receives a different addressing signal on operation of a different switch.

14. The transposing apparatus of claim 1, wherein said addressing unit further comprises a storage having output means connected with said switching unit and input means, and a plurality of switches, one for each of said keys and each operable in response to actuation of the corresponding key to transmit to the input means of said storage a signal corresponding to the ordinal number of the actuated key whereby the output means of said storage transmits a corresponding addressing signal to the respective input of said switching unit.

15. The transposing apparatus of claim 1, further comprising a storage having output means connected with the inputs of said switching unit, first input means arranged to receive that addressing signal which is generated in response to actuation of a given key, and second input means, said addressing unit further comprising selector means movable between a first position in which said second input means receives a signal enabling an addressing signal to pass from the first input means to the output means of said storage and a second position in which said storage blocks the transmission of addressing signals from said first input means to said output means thereof.

16. The transposing apparatus of claim 15, wherein said keys are actuatable as playing keys in the second position of said selector means.

17. The transposing apparatus of claim 1, further comprising a storage for continuous transmission of a selected addressing signal to said switching unit, said storage comprising at least one self-holding electric circuit.

18. The transposing apparatus of claim 1, wherein said addressing unit further comprises a discrete switch for each of said keys, said switches being operable in response to actuation of the associated keys to initiate the generation of corresponding addressing signals, and encoding means interposed between said switches and said main generator to convert the addressing signals into binary signals.

19. The transposing apparatus of claim 1, further comprising means for displaying said addressing signals.

20. The transposing apparatus of claim 19, wherein said displaying means includes at least one signal indicating element.

21. The transposing apparatus of claim 19, wherein said addressing unit further comprises means for converting said addressing signals into binary signals and said displaying means includes means for decoding said binary signals.

22. The transposing apparatus of claim 1, further comprising means for displaying one of said addressing signals.

23. The transposing apparatus of claim 22, wherein said addressing signals are binary signals.

24. The transposing apparatus of claim 22, wherein said addressing means further comprising multi-channel conductor means for transmission of addressing signals to said switching unit and said displaying means is connected with one channel of said conductor means.

25. The transposing apparatus of claim 1, wherein said switching unit comprises a plurality of interconnected electronic switches having several inputs and said addressing unit has several outputs for transmission of addressing signals to the switches of said switching unit.

26. The transposing apparatus of claim 25, wherein said electronic switches have interconnected outputs for transmission of said regulating signals.

27. The transposing apparatus of claim 1, wherein said switching unit comprises a multiplexer.

28. The transposing apparatus of claim 27, wherein said addressing unit is arranged to transmit to the inputs of said multiplexer addressing signals in the form of binary signals.

* * * * *